US007025504B2

(12) United States Patent
Olin

(10) Patent No.: US 7,025,504 B2
(45) **Date of Patent: *Apr. 11, 2006**

(54) FLEXIBLE BAG WITH RESEALABLE ANGLED POUR SPOUT

(75) Inventor: Alan D. Olin, 2086 Mills Ave., Menlo Park, CA (US) 94025

(73) Assignee: Alan D. Olin, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/855,765

(22) Filed: May 26, 2004

(65) Prior Publication Data

US 2004/0218839 A1 Nov. 4, 2004

Related U.S. Application Data

(60) Continuation of application No. 10/367,801, filed on Feb. 19, 2003, now Pat. No. 6,857,779, which is a continuation of application No. 09/804,526, filed on Mar. 10, 2001, now abandoned, which is a division of application No. 09/339,702, filed on Jun. 24, 1999, now Pat. No. 6,206,571.

(51) Int. Cl.
*B65D 33/16* (2006.01)

(52) U.S. Cl. ..... 383/204; 383/61.2; 383/120; 383/906

(58) Field of Classification Search ..... 383/203–204, 383/61.1, 61.2, 906, 120
See application file for complete search history.

(56) References Cited

U.S. PATENT DOCUMENTS 432,308 A 7/1890 Guilbert (Continued)

FOREIGN PATENT DOCUMENTS

FR 2 639 325 5/1990

(Continued)

OTHER PUBLICATIONS

Z-Patch Inc., Z-Patch In-Line Zipper Application System, Carbondale, IL 62901

*Primary Examiner*—Jes F. Pascua
(74) *Attorney, Agent, or Firm*—DLA Piper Rudnick Gray Cary U.S. LLP

(57) ABSTRACT

A reclosable bag having closed top and bottom ends, closed sides extending therebetween, and a closure region with a reclosable fastener. The fastener and one of the closed sides have an included angle less than 90 degrees. The fastener is further configured such that the reclosable fastener has a first end and a second end, and the sealed portion has a first end and a second end, the first end of the fastener generally extending to the closed first side so as to form a pour spout, the second end of the fastener generally extending to the first end of the sealed portion, and the second end of the sealed portion generally extending to the closed second side. In this manner, a pour spout is formed, that assists in pouring material from the bag. The pour spout can also be reclosed for convenience of the user.

6 Claims, 9 Drawing Sheets

U.S. PATENT DOCUMENTS

| | | | | |
|---|---|---|---|---|
| 2,020,804 | A | 11/1935 | Segal | |
| 2,188,039 | A | 1/1940 | Farmer | |
| 2,536,529 | A | 1/1951 | Bergstein | |
| 2,620,944 | A | 12/1952 | Stahl | |
| 2,952,394 | A | 9/1960 | Schneider | |
| 3,051,368 | A | 8/1962 | Schneider et al. | |
| 3,074,612 | A | 1/1963 | Schneider | |
| 3,077,295 | A | 2/1963 | Whiteford | |
| 3,143,277 | A | 8/1964 | LaFleur | |
| 3,367,380 | A | 2/1968 | Dickey | |
| 3,387,701 | A | 6/1968 | Schneider et al. | |
| 3,417,675 | A | 12/1968 | Ausnit | |
| 3,502,521 | A | 3/1970 | Doyen et al. | |
| 3,504,841 | A | 4/1970 | Bramson | |
| 3,520,471 | A | 7/1970 | Faust | |
| 3,640,381 | A | 2/1972 | Kanada et al. | |
| 3,815,810 | A | 6/1974 | Wellman | |
| 4,027,819 | A | 6/1977 | Herrera-Gutierrez | |
| 4,171,755 | A | 10/1979 | Carlisle | |
| 4,332,344 | A | 6/1982 | Strodthoff | |
| 4,454,979 | A | 6/1984 | Ikeda et al. | |
| 4,759,642 | A | 7/1988 | Van Erden et al. | |
| 4,787,755 | A | 11/1988 | Branson | |
| 4,946,289 | A | 8/1990 | Bolling et al. | |
| 4,953,708 | A | 9/1990 | Beer et al. | |
| 5,007,744 | A | 4/1991 | Scarberry et al. | |
| 5,060,803 | A | 10/1991 | Beer et al. | |
| 5,080,253 | A | 1/1992 | Zieke | |
| 5,104,235 | A | 4/1992 | Bronstrup et al. | |
| RE34,347 | E | 8/1993 | VanErden et al. | |
| 5,525,363 | A | 6/1996 | Herber et al. | |
| 5,593,229 | A | 1/1997 | Warr | |
| 5,609,420 | A | 3/1997 | Palmisano | |
| 5,611,626 | A | 3/1997 | Warr | |
| 5,687,848 | A | 11/1997 | Scholz et al. | |
| 5,716,473 | A | 2/1998 | Gordon et al. | |
| 5,941,643 | A | 8/1999 | Linkiewicz | |
| 6,007,246 | A | 12/1999 | Kinigakis et al. | |
| 6,053,635 | A | 4/2000 | Anderson et al. | |
| 6,164,826 | A | 12/2000 | Petkovsek | |
| 6,206,571 | B1 | 3/2001 | Olin | |
| 6,340,088 | B1 * | 1/2002 | Mouri et al. | 206/720 |
| 6,409,386 | B1 | 6/2002 | Trani et al. | |
| 6,572,267 | B1 * | 6/2003 | Forman | 383/61.2 |
| 6,773,163 | B1 * | 8/2004 | Ichikawa et al. | 383/61.2 |
| 6,820,391 | B1 * | 11/2004 | Barmore et al. | 53/133.4 |

FOREIGN PATENT DOCUMENTS

| | | |
|---|---|---|
| JP | 0212355 | 9/1991 |
| JP | 0240650 | 10/1991 |
| JP | 0240651 | 10/1991 |

* cited by examiner

FLEXIBLE BAG WITH RESEALABLE ANGLED POUR SPOUT

CROSS-REFERENCE TO RELATED APPLICATIONS

This application is a continuation of U.S. patent application Ser. No. 10/367,801 filed Feb. 19, 2003 now U.S. Pat. No. 6,857,779, which is a continuation of U.S. patent application Ser. No. 09/804,526, filed Mar. 10, 2001 now abandoned, which is a divisional application of U.S. patent application Ser. No. 09/339,702 filed Jun. 24, 1999, now U.S. Pat. No. 6,206,571.

TECHNICAL FIELD

The present invention relates generally to packaging for packaging pourable contents such as breakfast cereal, snack food product and the like, and more particularly to a flexible cereal bag provided with a reclosable pour spout.

BACKGROUND OF THE INVENTION

Packaging of breakfast cereal is customarily effected by sealing the dry cereal product within a plastic bag and storing the filled bag within a suitably sized cardboard box or carton. A disadvantage with this type of packaging is that once the sealed bag is opened, it is difficult to reseal the bag in an airtight manner necessary to maintain freshness of the cereal product.

In order to close a conventional cereal bag after the sealed top end has been opened, the user will typically fold the opened end of the bag over onto it self one or more times. Closing the bag in this way is awkward. Oftentimes, the user will simply stuff the opened end of the bag down into the box without regard to properly sealing the opening. Once opened, the conventional cereal bag is never again airtight. In humid climates, in particular, exposure of the dry cereal product to air quickly compromises the freshness of the cereal product. Furthermore, as additional serving portions of the cereal product are emptied from the bag with each use, it becomes more difficult to effectively seal close the open end of the bag by rolling the bag within the depth of the box or carton.

Another problem with conventional cereal bags is that it is difficult to open the sealed top end of the bag without also ripping or tearing the side panel walls of the bag. An unevenly opened bag often has an overhanging portion that blocks or traps cereal during pouring. In the case where the bag is used as a liner within a box, the overhanging portion of the ripped open bag often also causes spillage of the cereal contents into the crevice space between the bag and the box as the box is returned to the upright position. A flexible bay formed with an easily openable reclosable pour spout that overcomes the above-noted problems of the prior art would be desirable.

Flexible plastic bags or cereal box liners having a reclosable fastener or zipper for packaging cereal are known from the prior art. Examples of prior art flexible plastic bags having a reclosable fastener are found in U.S. Pat. Nos. 4,759,642, 4,946,289, and 5,080,253. In each of the bags disclosed is these patent documents, the reclosable fastener extends transversely across the entire width of the bag. None of these patent documents disclose or teach a bag having a reclosable fastener or associated structure that is configured to form a natural pour spout when the zipper material is opened. Quaker Oats currently markets a cereal bag having a zipper-type reclosable fastener under the trademark ZIP PAK. Like the prior art noted above, the reclosable fastener of the ZIP PAK bag extends across the entire width of the bag. The ZIP PAK bags, like most cereal bags on the market these days, are mass produced from a single web of film material using conventional in-line vertical form, fill and seal (VFFS) packaging equipment. As a result of the VFFS production process, the overlying front and rear panel walls of the bag are joined together by a joining fin seal that runs the longitudinal length of the bag. In the ZIP PAK bags, in particular, the joining fin seal bisects the zipper-type reclosable fastener across the top of the bag. Thus, there is a tendency for the joining fin seal to obstruct zipper closure action as the user applies thumb and finger pressure in a sweeping motion across the length of the zipper-type reclosable fastener. This obstruction often results in the bag not being completely sealed. Difficulty in airtight resealing a bag with such "full width" zip closures is compounded in the case where the bag is also used as a box liner.

U.S. Pat. Nos. 4,953,708 and 5,060,803 disclose flexible bags that form pour spouts when opened. The bags in these patent documents lack any resealable structure for the pour spouts and they require the sides of the bag to be gussetted which increases the cost of manufacture.

U.S. Pat. No. 4,332,344 discloses a flexible package for enclosing liquid or granular products which includes a tubular plastic bag and a pleated reclosable pour spout that is appended to the side edge of the bag. A bag of this configuration is complex in design and would be extremely expensive and difficult to mass manufacture using conventional VFFS equipment.

U.S. Pat. No. 5,611,626 discloses a bag with a corner tear-away pour spout opening. This patent teaches to reseal the bag after each use by attaching a separate adhesive patch to cover the corner pour spout opening. A drawback with this resealing approach is that the glue on the adhesive patch tends to loose its effectiveness after repeated uses. Also, since the adhesive patch is separable from the bag, it may become lost through carelessness of the user, thereby leaving the user without a convenient means for resealing the bag.

Accordingly, a bag having a pour spout which includes integral structure or means for resealing the pour spout and which is also easily mass produced using conventional VFFS equipment would constitute a significant advance in the art.

SUMMARY OF THE INVENTION

It is therefore a general object of the present invention to provide a flexible bag (or box liner) for packaging pourable contents such as dry cereal or snack food product, and wherein the bag is formed with an integral reclosable pour spout that is easy to open, pour cereal from, seal, and close.

It is a further object of the present invention to provide a design for a plastic bag (or box liner) having a reclosable pour spout which is simple in construction, low in cost, and well suited for mass production using conventional VFFS techniques.

In one embodiment of the invention, a reclosable bag comprises closed top and bottom ends, closed first and second sides extending between the closed top and bottom ends, and an interior portion configured to store material. The bag also has a first closure region at least partially defined by the closed top end and a tear strip, the tear strip disposed inward of the closed top end. In addition, the bag has a second closure region disposed inward of the first closure region and the tear strip, the second closure region including a reclosable fastener and a sealed portion. The reclosable fastener is configured to open so as to expose the interior portion. Also, the reclosable fastener and the closed first side have an included angle less than 90 degrees. The reclosable fastener has a first end and a second end, and the sealed portion has a first end and a second end, the first end of the fastener generally extending to the closed first side so as to form a pour spout, the second end of the fastener generally extending to the first end of the sealed portion, and the second end of the sealed portion generally extending to the closed second side.

Other and further objects of the present invention will be apparent from the following description and claims, and are illustrated in the accompanying drawings, which by way of example, show preferred embodiments of the present invention and principles thereof. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

DETAILED DESCRIPTION OF THE PREFERRED EMBODIMENTS

Figure 1:
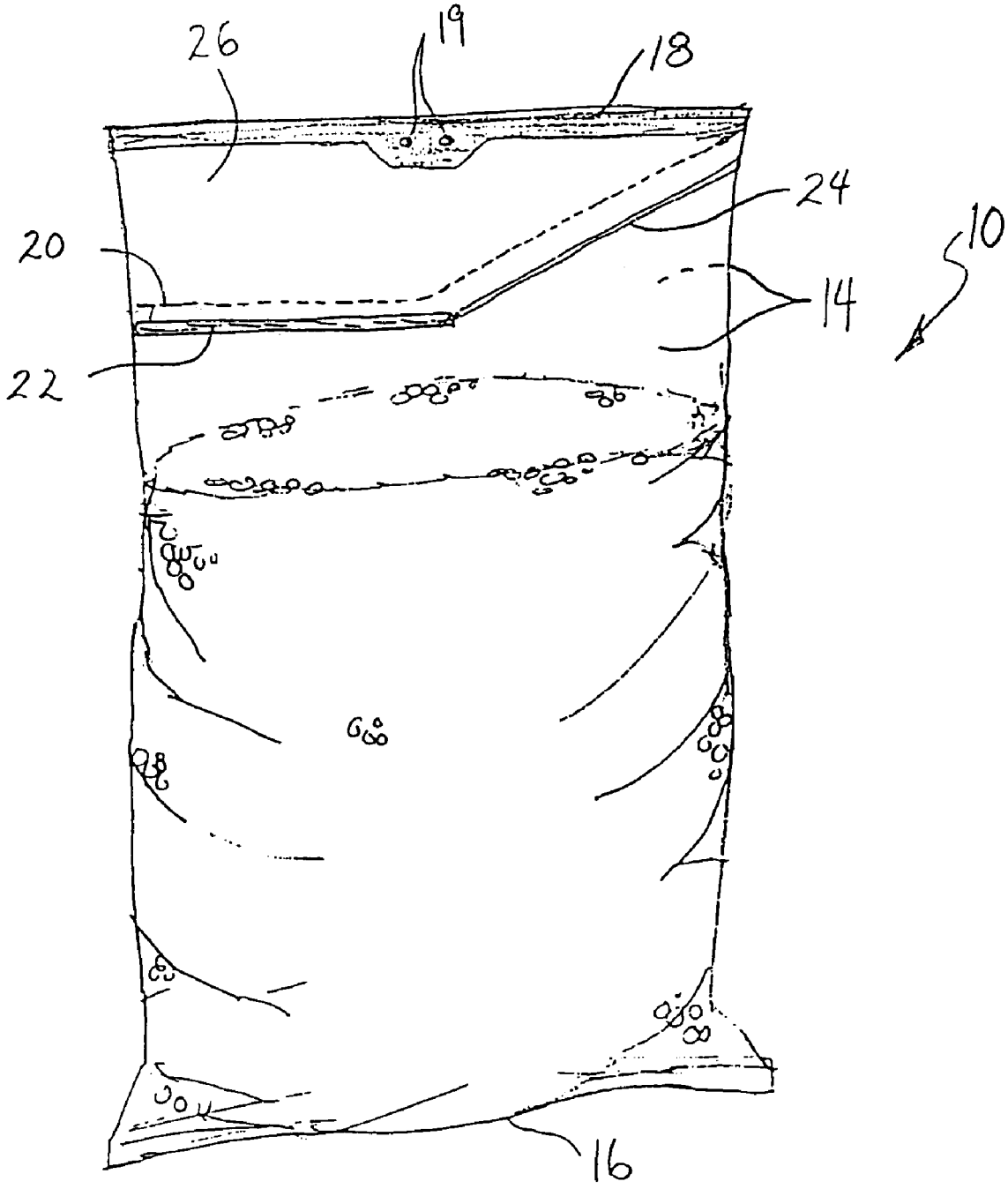
FIG. 1 is a generally schematic view of a flexible bag with resealable pour spout in accordance with a first embodiment of the present invention.
Figure 2:
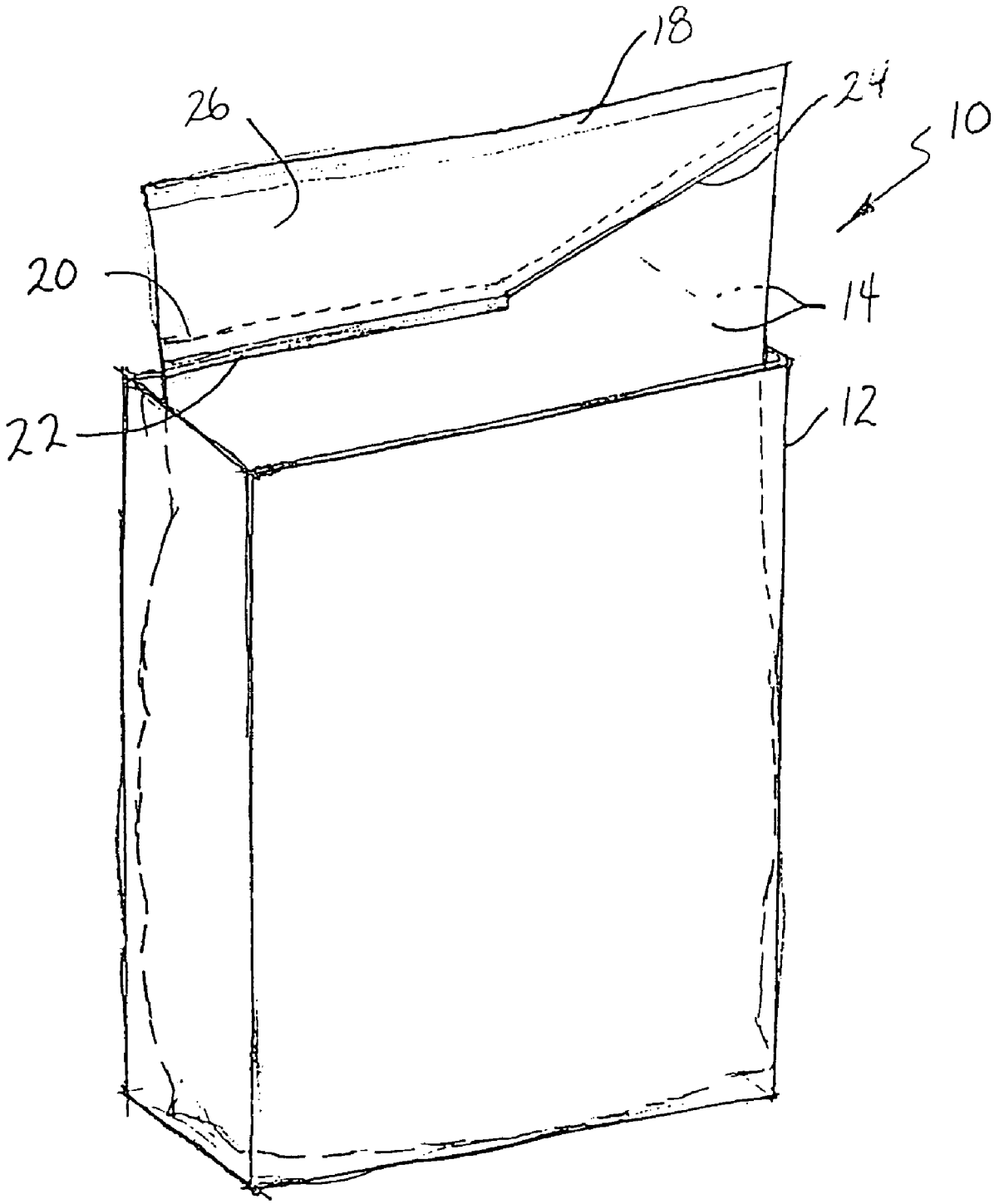
FIG. 2 is a generally schematic view of the bag of FIG. 1 shown received within a storage and handling carton.
Figure 3:
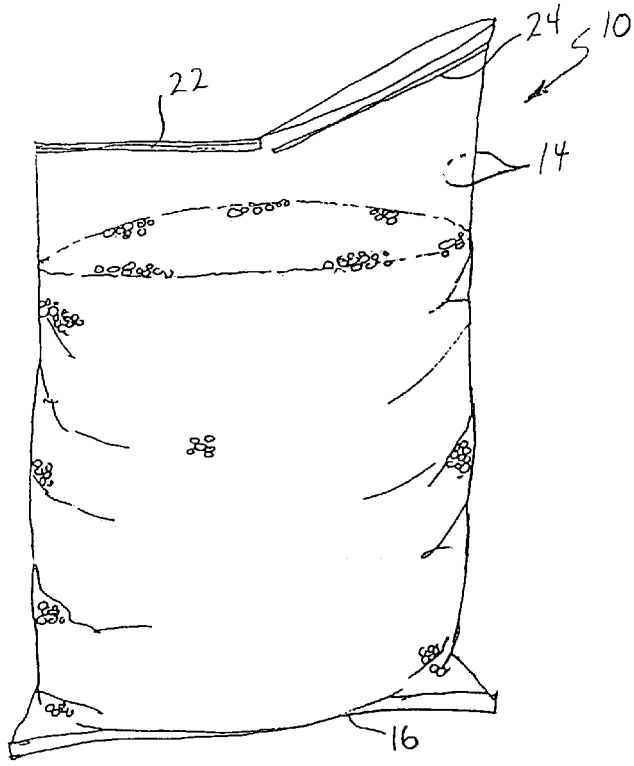
FIG. 3 is a generally schematic view of the bag of FIG. 1 after removal of the tear away upper portion to access to the removable pour spout.

A flexible bag formed with a reclosable pour spout constructed in accordance with a preferred embodiment of the present invention is designated generally by reference numeral 10 in FIGS. 1–3. The bag 10 is especially well suited for packaging pourable contents such as, for example, dry breakfast cereal. In accordance with the conventional practice for packaging breakfast cereal, the bag 10 may be used alone as the sole source of packaging (see FIGS. 1 and 3) or, the bag 10 may be received within a close fitting carton or box 12 (see FIG. 2).

The bag 10 is formed from thermoplastic sheet or film material, and has overlying front and rear wall panels 14 and a closed bottom end 16. In the preferred embodiment, the closed bottom end 16 is formed as a sealed seam using conventional heat sealing means.

For purposes of example and illustration, the bag 10 is a flat tube-type bag formed of a single sheet of material which is folded over onto itself to form a joining fin seal (not shown) that runs the longitudinal length of the bag 10. However, bags incorporating the invention of this application may be fabricated in a side-gusset tube style, side gusset back seam style, or any other suitable bag design.

The upper portion 26 of the bag 10 comprises a first closure region terminating in a sealed top end 18. One or more openings 19 may be provided to the sealed top end 18 to permit hanging of the bag from hooks at a retail display site. The sealed top end 18 is preferably reinforced in the area surrounding the openings 19 so that the weight of the filled bag 10 does not cause the hooks to rip through the top sealed end 18 at the openings 19.

The upper portion 26 of the bag 10 further comprises a second closure region which includes a tear strip 20 followed by an inwardly adjacent inner heat seal 22 and reclosable fastener 24. The tear strip 20 extends across the entire width of the bag 10 whereas the inner heat seal 22 only extends across a portion of the bag width having a first end located at one side of the bag 10 and a second end terminating at a distance from the opposite side of the bag 10. The reclosable fastener 24 begins where the heat seal 22 leaves off and extends across the remaining width of the bag 10 to terminate at the other side of the bag 10. As can be seen in the drawings, the inner heat seal 22 extends in the transverse direction approximately one half the width of the bag 10, although it is understood that this distance and orientation may vary.

In this embodiment, the reclosable fastener 24 is oriented along an upward oblique angle relative to the inner heat seal 22. In use, the upper portion 26 of the bag 10 is first separated from the lower portion of the bag 10 by tearing along tear strip 20 to expose the reclosable fastener (see FIG. 3).

In the case where the bag 10 is to be received within a close fitting box 12 (e.g., see FIG. 2), the height of the bag 10 is preferably designed to be taller than depth of the box 12 such that once the top of the box 12 is opened, the upwardly angled reclosable fastener 24 extends beyond the top of the box 12. In this way, the upwardly angled reclosable fastener 24 forms natural pour spout for the enclosed cereal contents. The pour spout is preferably large enough to clear any flap portions of the opened box top. The reclosable fastener 24 is preferably of the reclosable zipper type fastener that is widely used in sandwich bags and freezer bags and like food storage bags.

Referring now to FIGS. 4 to 19, various alternate embodiments of the present invention will now be described. Structural elements of the alternate embodiments common to the preferred embodiment of FIGS. 1–3 are indicated by identical reference numerals. In each of the alternate embodiments, the box 12 is shown in phantom to indicate the box 12 as an optional feature.

Figure 4:
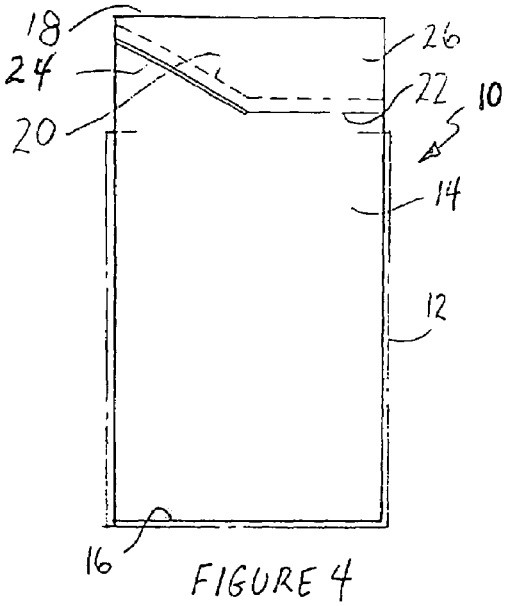
FIGS. 4 to 19 are a series of simplified schematic views similar to FIG. 1, but which illustrate various alternate embodiments of the present invention.

FIG. 4 shows a four corner bag 10 (or box liner) provided with a sealed bottom end 16 and sealed top end 18. Inner heat seal 22 is horizontally oriented across a portion of the width of the bag 10 and is spaced at distance from the sealed top end 18. The reclosable fastener 24 continue across the remaining portion of the bag 10 and is oriented along an upwardly sloping angle relative to the horizontally oriented inner heat seal 22. The bag 10 further includes a tear strip 20 disposed inwardly of (i.e., above) and closely following the profile of the inner heat seal 22 and reclosable fastener 24. In this embodiment, the reclosable fastener 24 extends approximately half way across the bag 10. It is understood, however, that the extension length of the reclosable fastener and angle of orientation may be shortened as desired to conserve on expensive zipper material This embodiment is one of the easiest designs to open, pour, reseal, and close. As before, the upper portion 26 of the bag 10 is designed to be taller than the box 12 (when the bag 10 is used as a bag liner) so that the upwardly angled reclosable fastener 24 forms a natural pour spout during use. The main difference between the embodiment of FIG. 4 and the embodiment of FIG. 1 is the absence of holes in the upper top sealed edge 18 for hanging and displaying the bag 10.

Figure 5:
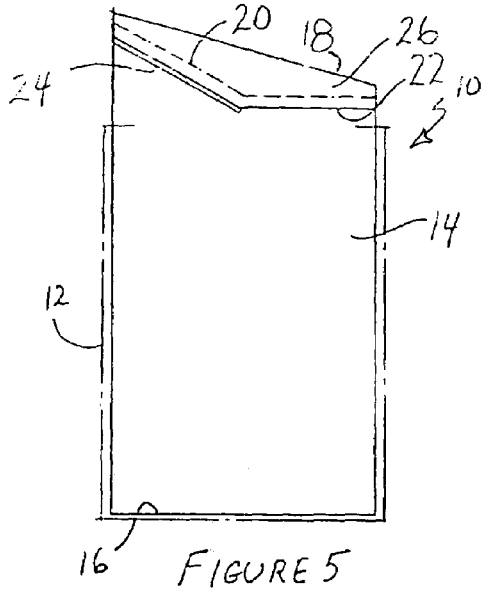

FIG. 5 shows a bag similar to that shown in FIG. 4 except that the sealed top end 18 is angled downward to roughly follow the contour of the angled reclosable fastener 24. An advantage of this design is that less bag material is required in view of the angled sealed top end 1.

Although not shown in any of the drawings, a modified version of the FIG. 5 embodiment may eliminate the tear strip 20, the reclosable fastener 24, and the inner heat seal 22, leaving only a four corner bag with an angled seal top end 18. Once opened, the angled top end of this modified version would form a natural pour spout. This is a useful feature that is not present in the prior art four corner cereal bags having a horizontal sealed top edge.

Figure 6:
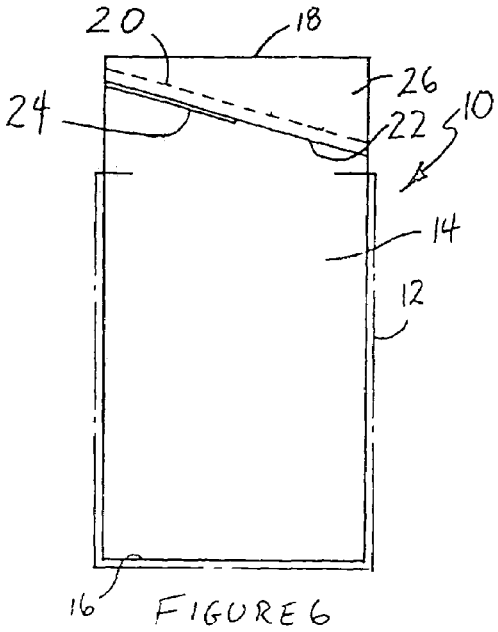

FIG. 6 shows a four corner bag 10 similar to that shown in FIG. 4 except that the inner heat seal 22 and reclosable fastener 24 are colinear and are oriented along an upwardly inclined angle as shown. The tear strip 20 is similarly angled and is positioned just above the inner heat seal 22 and reclosable fastener 24. The upwardly inclined angle of the reclosable fastener forms a natural pour spout for the bag upon removal of the tear strip 20.

Figure 7:
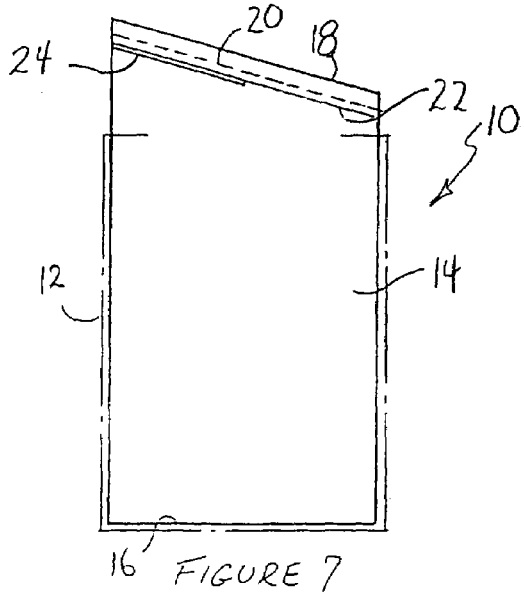

FIG. 7 shows a four corner bag 10 similar to that shown in FIG. 6 except that the sealed top end 18 is also angled to be parallel with the angle of the colinear inner heat seal 22 and reclosable fastener 24 and tear strip 20. The embodiment of FIG. 7 has less bag material as compared to the four corner bag designs with a horizontal top sealed end.

Figure 8:
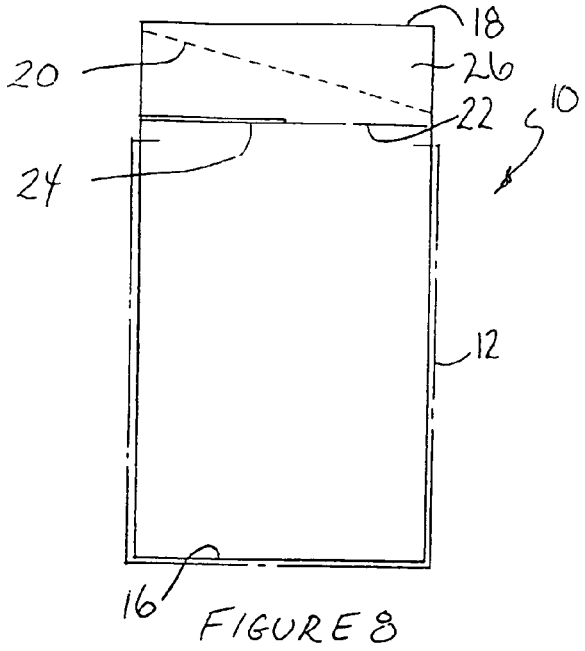

FIG. 8 shows a four corner bag 10 having a horizonal sealed top end 18 with a inner heat seal 22 and reclosable fastener 24 oriented along line parallel to the sealed top end 18 and spaced a distance inwardly therefrom. The tear strip 20 is positioned between the sealed top end 18 and the colinear inner heat seal 22 and reclosable fastener 24 and is oriented at an upward angle so as to form a pour spout above the reclosable fastener 24.

Figure 9:
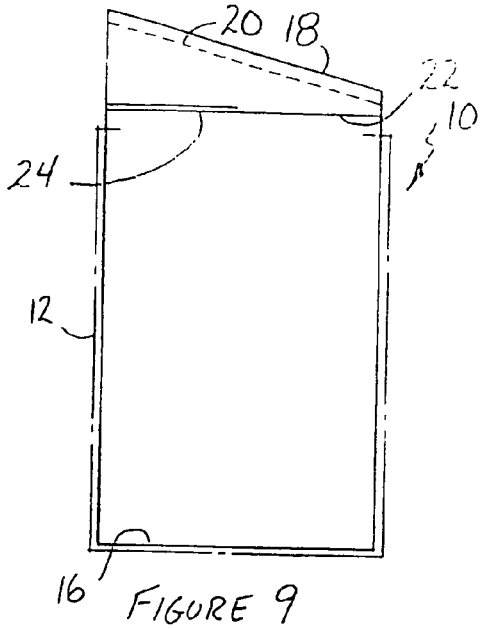

FIG. 9 shows a four corner bag 10 similar to that shown in FIG. 8 except that the sealed top end is also angled to be parallel with the angle of the upwardly inclined tear strip 20.

Figure 10A:
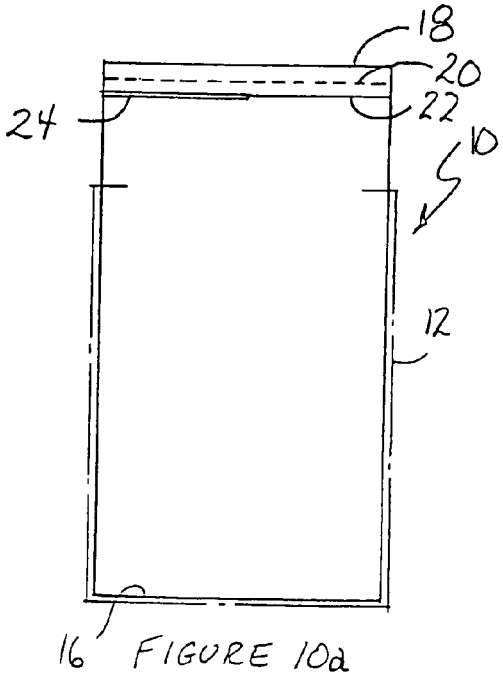

FIG. 10*a* shows a four corner bag 10 having a horizonal sealed top end 18 with an inner heat seal 22 and reclosable fastener 24 both of which are oriented along line parallel to and spaced in close proximity with the sealed top end 18. The tear strip 20 is positioned between the sealed top end 18 and the colinear inner heat seal 22 and reclosable fastener 24.

Figure 10B:
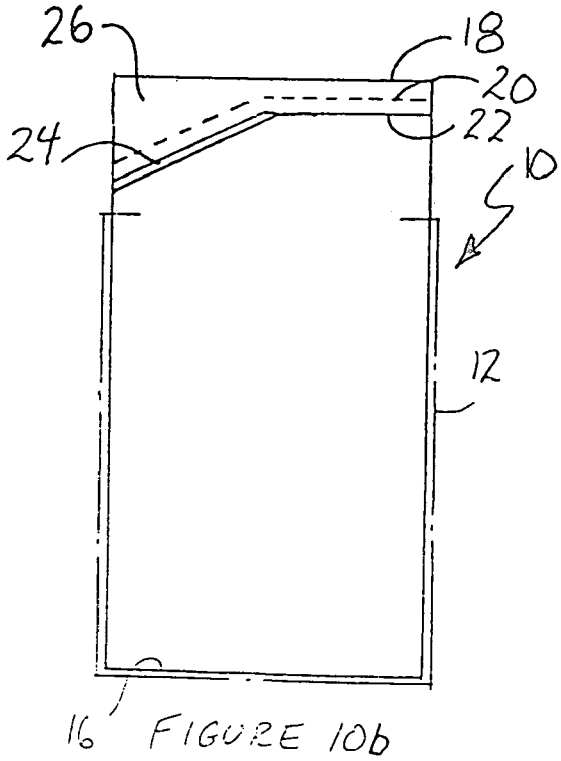

FIG. 10*b* shows a four corner bag 10 having a horizonal sealed top end 18 with an inner heat seal 22 oriented transversely across a portion of the bag and spaced in close proximity with the sealed top end 18. Reclosable fastener 24 spans the remaining width portion of the bag 10 and is oriented at a downward sloping angle relative to the horizontally oriented inner heat seal 22 so as to form a natural pour spout upon opening of the bag. The tear strip 20 is positioned inwardly of the sealed top end 18 and follows both the horizontal path of the inner heat seal 22 and the downward slope of the reclosable fastener 24.

Figure 11:
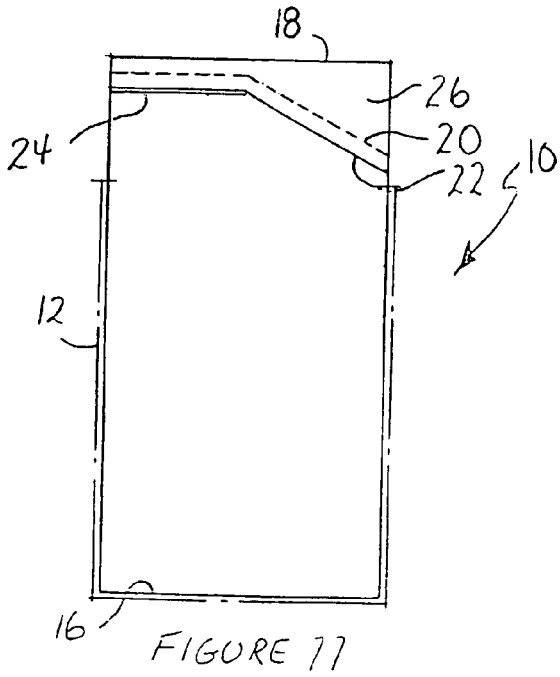

FIG. 11 show a four corner bag 10 similar to that show in FIG. 10 except that the inner beat seal 22 is downwardly angled with respect to the reclosable fastener 24. The profile of the tear strip 20 closely follows the horizontal orientation of the reclosable fastener 24 and the downwardly sloping orientation of the inner heat seal 22.

Turning now to FIGS. 12 to 19, various other embodiments of the invention which do not have an inner heat seal disposed inwardly of a reclosable fastener will be described.

Figure 12:
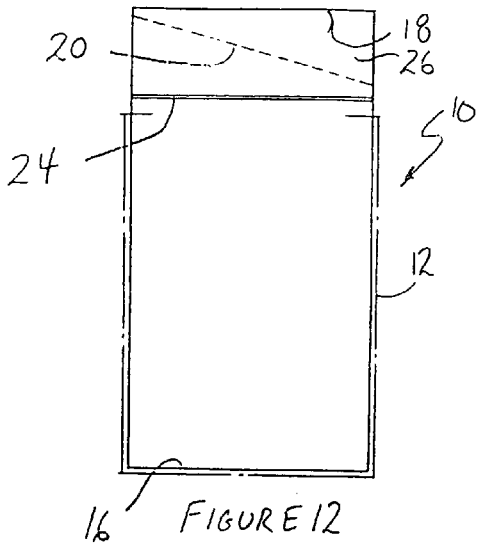

FIG. 12 shows a four corner bag 10 having a horizonal sealed top end 18 with a full reclosable fastener 24 that extends transversely or horizontally across the width of the bag 10 and is spaced at a distance inwardly from the sealed top end 18. The tear strip 20 is positioned between the sealed top end 18 and the reclosable fastener 24 and is oriented at an upward angle so as to form a pour spout above the reclosable fastener 24.

Figure 13:
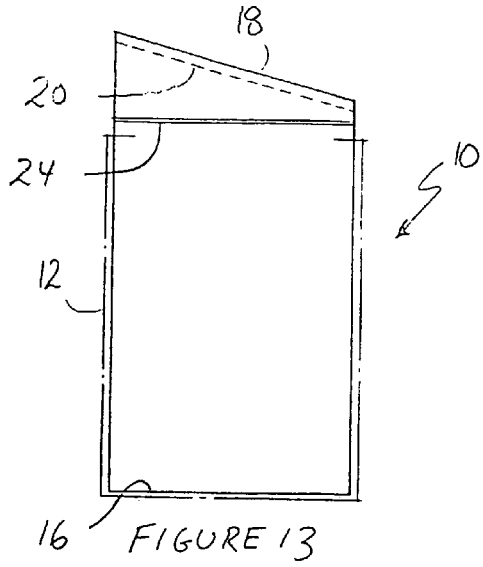

FIG. 13 shows a four corner bag 10 similar to that shown in FIG. 12 except that the sealed top end 18 is also angled along a downward slope to be parallel with the angle off the tear strip 20.

Figure 14:
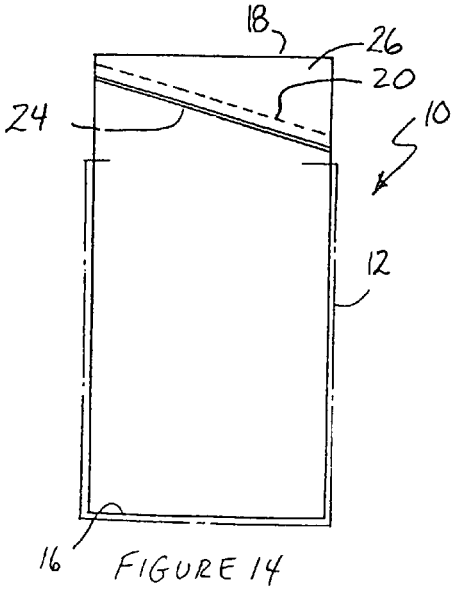

FIG. 14 shows a four corner bag 10 having a horizontal sealed top end 18 similar to FIG. 12 except that the full width reclosable fastener 24 extends along an upwardly sloping angle across the width of the bag 10. The reclosable fastener 24 is oriented at the upward angle is configured with a first end of said reclosable fastener disposed at a fist side of said bag at a hih location (relative to the bottom 16 of the bag) and a second end of the reclosable fastener being disposed at a position on said bag which is located a distance down (the spaced distance inward and toward the bottom 16 of the bag) and transverse from the high location at the first side of said bag. In the embodiment shown the transverse distance is the full width of the bag (from the first side to a second side). The tear strip 20 is located just above the reclosable fastener 24.

Figure 15:
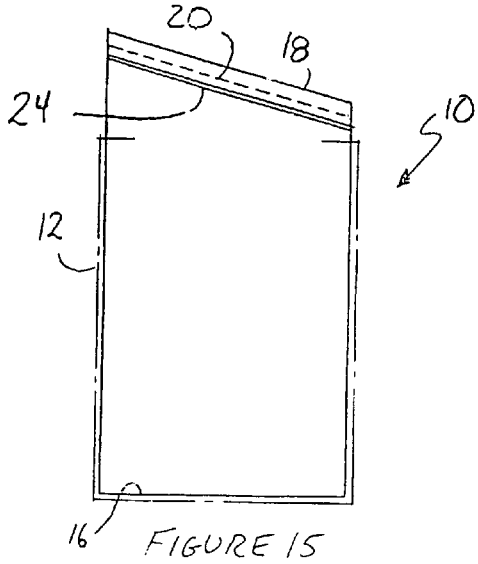

FIG. 15 shows a four corner bag 10 similar to that shown in FIG. 14 except that the sealed top end 18 is also angled along a downward slope to be parallel with the angle of the tear strip 20 and full width reclosable fastener 24.

Figure 16:
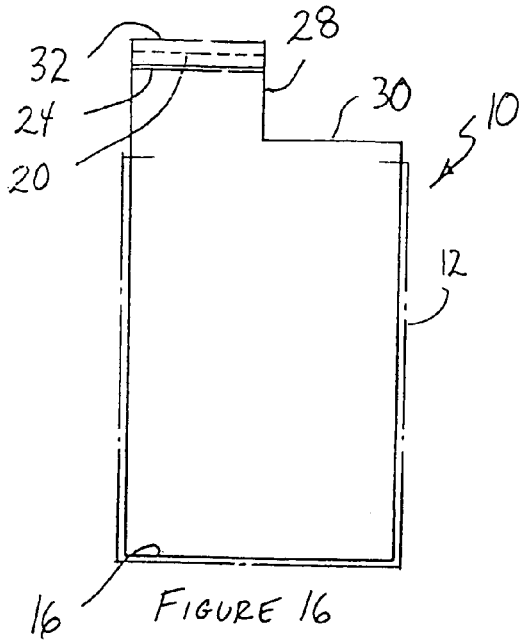

FIG. 16 shows a six corner bag 10 of generally L shape configuration with an upper corner extension that is approximately one half the width of the bag 10. Sealed edges 28, 30, and 32 form the upper closed boundary of the bag 10. As is the case with the sealed seams disclosed in the above-described embodiments, the sealed edges 28, 30 and 32 are formed using conventional sealing means. Horizontally oriented reclosable fastener 24 is disposed in close proximity with the uppermost sealed edge 32 and is separated therefrom by an intermediate tear strip 24.

Figure 17:
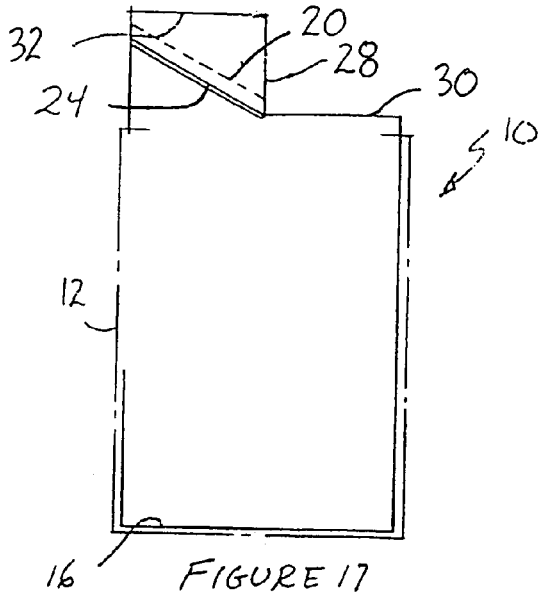

FIG. 17 shows a six corner bag 10 similar to that shown in FIG. 16 except that reclosable fastener 24 and tear strip 22 are upwardly angled relative to the transversely oriented sealed edge 30. This design is similar to that shown in FIG. 4.

Figure 18:
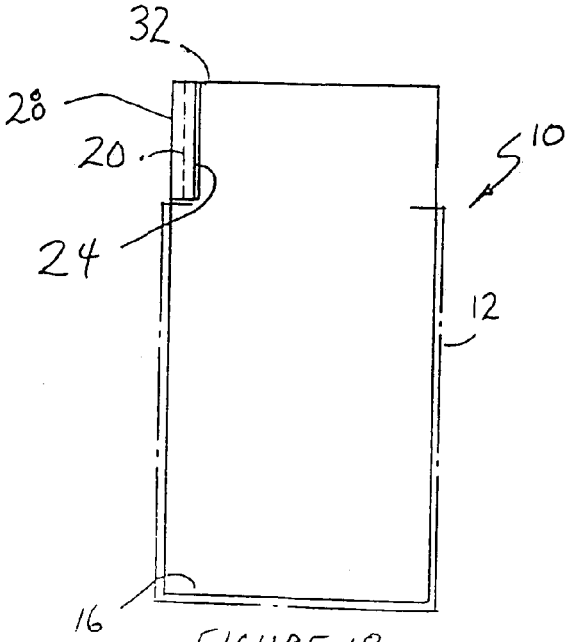

FIG. 18 shows a four corner bag 10 having an uppermost sealed edge 32 and a vertically oriented reclosable fastener 24 disposed at an upper corner region of the bag 10. As shown in FIG. 18, the vertical sides of bag 10 are about 2.25 times the length of top 32 edge and bottom edge 16 which are also shown parallel to each other. Reclosable fastener 24 is located at the upper end of the left side in FIG. 18 with one end coupled to an end of top edge 32 and a second end coupled to the seam of the left side about a quarter of the length a side down from top edge 32. Additionally, when the top of bag 10 is withdrawn from the top of box 12, the entire length of reclosable fastener 24 is shown extending above the top edge of box 12. A tear strip 20, followed by vertically oriented sealed edge 28, are located outwardly of the vertically oriented reclosable fastener 24.

Figure 19:
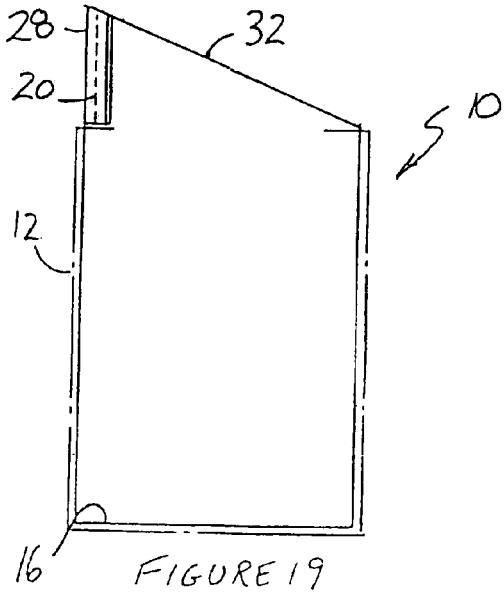
Figure 20:
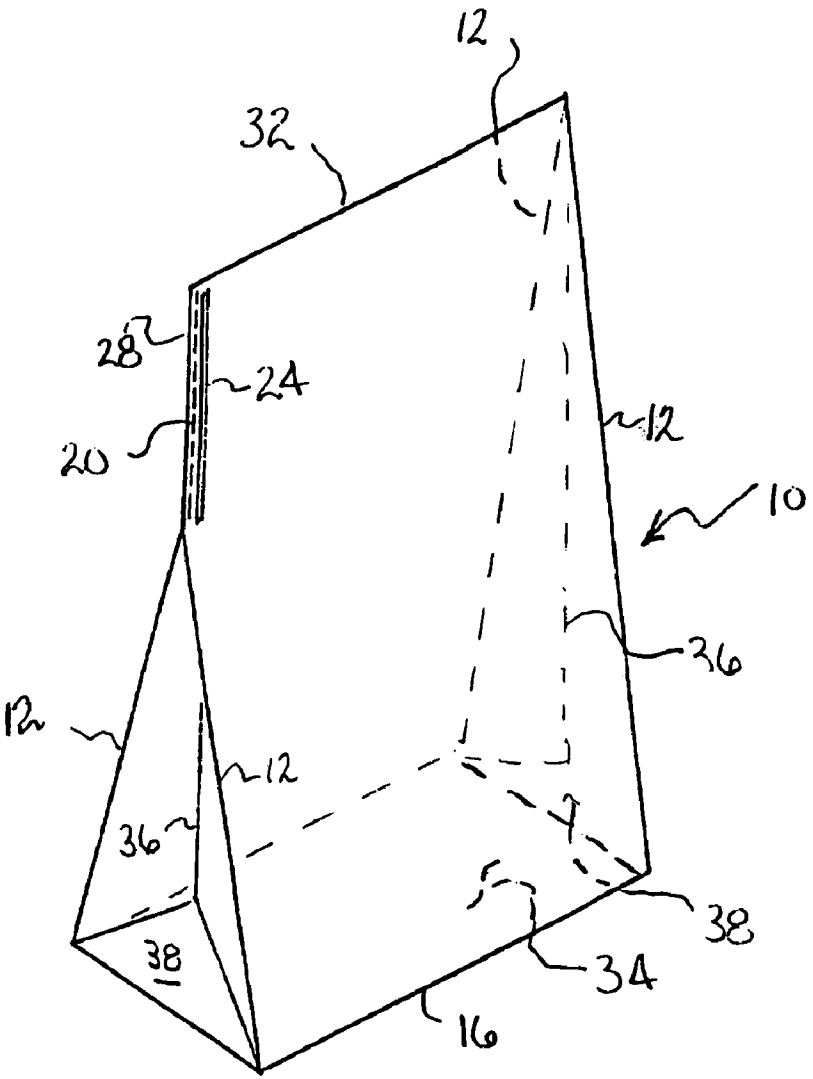
Figure 21:
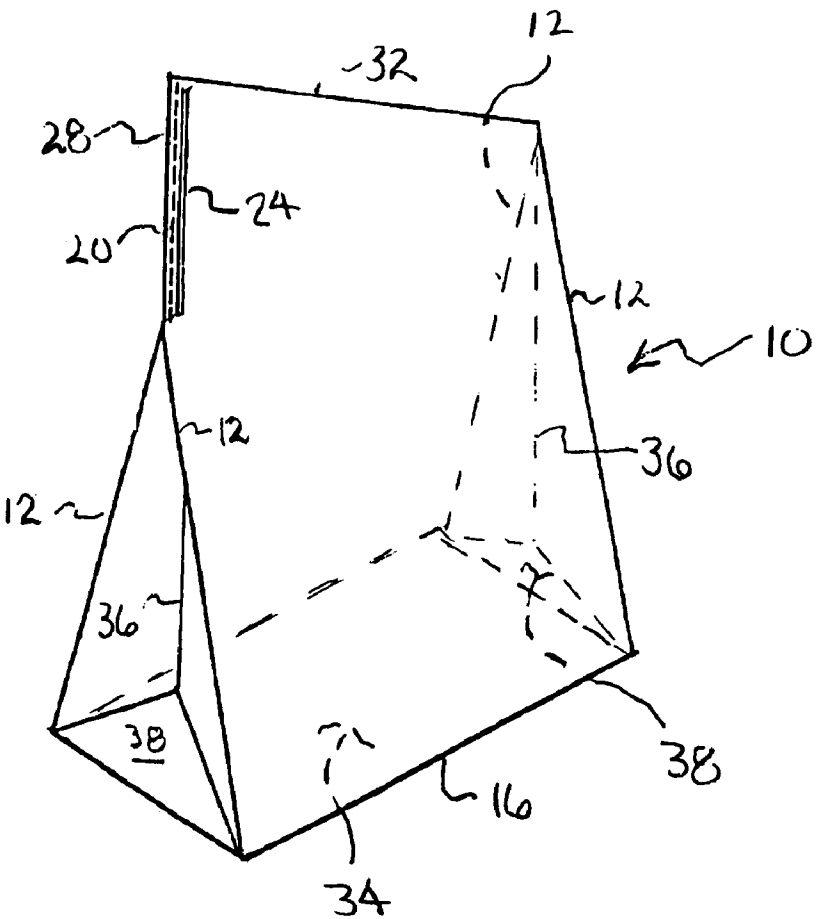

FIG. 19 shows a four corner bag 10 similar to that shown in FIG. 18 except that the uppermost sealed edge 32 is angled along a downward slope to conserve bag material. In this view, reclosable fastener 24 is shown at the top of the longer of the two sides. As shown here with the top of the bag 10 withdrawn from box 12, the entire length of reclosable fastener 24 extends above the top edge of box 12 with top edge 32 sloping downward to a point on the opposite edge that is approximately even with the top edge of box 12.

In the embodiment of FIGS. 18 and 19, the reclosable fastener is vertically or longitudinally oriented and disposed adjacent a side edge at an upper corner region of the bag. Additionally, in FIG. 18, all four corners of bag 10 are shown as having an included right angle. In FIG. 19, however, the two corners at the bottom of the bag are shown as having an included right angle, the upper corner between side 12 and the top of the bag is shown as having an included acute (less than 90°) angle, and the other upper corner of the bag is shown as having an included obtuse (grater than 90°) angle.

The invention claimed is:

1. A reclosable bag, comprising:

closed top and bottom ends, closed first and second sides extending between the closed top and bottom ends, and an interior portion configured to store material;

a first closure region at least partially defined by the closed top end and a tear strip, the tear strip disposed inward of the closed top end;

a second closure region disposed inward of the first closure region and the tear strip, the second closure region including a reclosable fastener and a sealed portion;

wherein the reclosable fastener is configured to open so as to expose the interior portion; and wherein the reclosable fastener and the closed first side have an included angle less than 90 degrees; and wherein the reclosable fastener has a first end and a second end, and the sealed portion has a first end and a second end, the first end of the fastener generally extending to the closed first side so as to form a pour spout, the second end of the fastener generally extending to the first end of the sealed portion, and the second end of the sealed portion generally extending to the closed second side.

2. The reclosable bag of claim 1 wherein the sealed portion and the closed second side have an included angle of approximately 90 degrees.

3. The reclosable bag of claim 1 wherein the sealed portion is approximately collinear with the reclosable fastener.

4. The reclosable bag of claim 1 wherein the closed top end and the closed second side have an included angle of approximately 90 degrees.

5. The reclosable bag of claim 1 wherein the closed top end is approximately parallel to the reclosable fastener.

6. The reclosable bag of claim 1 wherein the closed first and second sides are gusseted sides.

* * * * *